US007004791B2

(12) United States Patent
Mumper et al.

(10) Patent No.: US 7,004,791 B2
(45) Date of Patent: Feb. 28, 2006

(54) CONTACT HOUSING AND PROCESS FOR MAKING A CONTACT HOUSING

(75) Inventors: Guenther Mumper, Egelsbach (DE); Konrad Helmut Roth, Fraenkisch-Crumbach (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 10/964,180

(22) Filed: Oct. 13, 2004

(65) Prior Publication Data

US 2005/0118867 A1 Jun. 2, 2005

(30) Foreign Application Priority Data

Oct. 16, 2003 (EP) ..... 03023585

(51) Int. Cl.
*H01R 13/40* (2006.01)

(52) U.S. Cl. ..... 439/595; 439/596

(58) Field of Classification Search ..... 439/595, 439/752; 264/272.11, 295, 336, 318, 632, 264/633, 224
See application file for complete search history.

(56) References Cited

U.S. PATENT DOCUMENTS 5,839,921 A * 11/1998 Yamanashi ..... 439/595
5,888,103 A * 3/1999 Norizuki et al. ..... 439/701
6,024,605 A * 2/2000 Beck et al. ..... 439/595
6,027,374 A * 2/2000 Nagai et al. ..... 439/596
6,589,082 B1 * 7/2003 Harasawa et al. ..... 439/752

FOREIGN PATENT DOCUMENTS

| | | |
|---|---|---|
| DE | 19600236 A2 | 7/1996 |
| FR | 2706687 | 12/1994 |
| GB | 2024537 A | 1/1980 |

* cited by examiner

*Primary Examiner*—Tho D. Ta
*Assistant Examiner*—Vanessa Girardi
(74) *Attorney, Agent, or Firm*—Barley Snyder LLC

(57) ABSTRACT

A connector housing and a process for making same, in which the connector housing comprises a base part and a pivoting part, attached to the base part and made in one piece with the base part. The pivoting part has at least one surface delimiting an insertion opening in the connector housing through which a pin contact may be inserted into a socket contact in the connector housing. The connector housing being injection molded, with the pivoting part located in an open position, providing sufficient space for the molds for shaping a latching hook. After the mold has been removed, the pivoting part is moved into a closed position in which the delimiting surface of the pivoting part is moved towards the insertion opening. The connector housing cures with the pivoting part in the closed position. The socket contact is held in a contact chamber by a latching hook.

24 Claims, 2 Drawing Sheets

CONTACT HOUSING AND PROCESS FOR MAKING A CONTACT HOUSING

FIELD OF THE INVENTION

The invention relates to a connector housing and processes for making a connector housing.

BACKGROUND

Connector housings are used to hold a socket contact into which a pin contact may be pushed. To improve introduction of the pin contact into an introduction opening, the connector housing has, arranged around the introduction opening, delimiting surfaces which are inclined in the direction of the center of the introduction opening. The socket contact is secured by a latching hook to prevent its being withdrawn from the connector housing.

DE 196 00 236 A1 discloses a housing element of an electrical connector. The housing element has a body with passages provided to receive a contact member. Further provided is a locking key which is provided with protuberances for engagement in slots which open into the passages. The protuberances have a width corresponding to the dimension of the apertures, which extend over the entire width of the passages. The protuberances are lengthened to form bosses. The contact member is made in the form of a socket contact whereof the plug receiving region has associated with it a plug opening in the housing. The plug opening is surrounded by delimiting surfaces. In the region of the plug opening, the housing body is made in one piece. To hold the socket contact, a lug is provided as a latching hook which latches into a corresponding latching slot in the socket contact when the socket contact is pushed into the housing.

In many cases, the housings are made from synthetic material by an injection molding process. When the housing is made, it is necessary for the latching hook to be shaped in the housing using a mold. It is moreover necessary to form between the latching hook and the housing wall a receiving space into which the latching hook can spring back when a contact is pushed in. To remove the mold once the shaping procedure is complete a sufficiently large opening has to be made in the housing. In the case of small housings, it may be that there is no surface available large enough for the opening to be provided.

To solve this problem, French patent application FR 2 706 687 A1 proposes a two-part housing in which some of the delimiting surfaces for the plug opening of the housing are formed by a separate plug receiving part. In this way, it becomes possible to make the housing separately from the plug receiving part. This allows a large opening for the mold to be provided, and this opening is at least partly closed by the plug receiving part in the mounted condition. Thus, the housing, together with the latching hook, can be removed from the mold without problems. The plug receiving part is then pushed into the corresponding opening in the housing. The plug openings each have four delimiting surfaces which taper conically inwards. Three of the delimiting surfaces are formed by the housing. The fourth delimiting surface is formed by the plug receiving part. The plug receiving part moreover has a blocking element which is pushed into a free space between the movable latching hook and the housing. This means that the latching hook is held in a latched position. The process described for making a connector housing is relatively complicated.

SUMMARY

In an exemplary embodiment, the present invention provides a connector housing and a process for making a connector housing by means of which a latching hook can be shaped even if the connector housing is small and has little surface available for providing the mold.

The connector housing has a base part and a pivoting part which each form part of the delimiting surface of the opening to the contact chamber, with the delimiting surfaces of the pivoting part and the housing abutting against one another by way of abutment surfaces, and with the housing base and the pivoting part being made in one piece. In this way it becomes possible to make the contact housing by an injection molding process, with the pivoting part located in an open position during manufacture. In the open position, sufficient space is available between the pivoting part and the housing for the mold in order to shape the latching hook. After removal from the mold, the pivoting part is moved into the closed position and an insertion opening to the contact chamber is made, with four delimiting surfaces. The insertion opening can be made relatively small because of the manufacturing process.

In a further embodiment of the invention, the mold opening for receiving the mold is made outside the opening to the contact chamber, so that there is greater flexibility in the design of the contact housing. The contact housings and the manufacturing processes described make it possible to shape contact housings with a latching hook even though the contact housing has no surface available sufficient for an opening for providing the mold.

BRIEF DESCRIPTION OF THE DRAWINGS

The invention will be explained below in more detail with reference to the figures, in which.

DETAILED DESCRIPTION OF THE EMBODIMENT(S)

Figure 1:
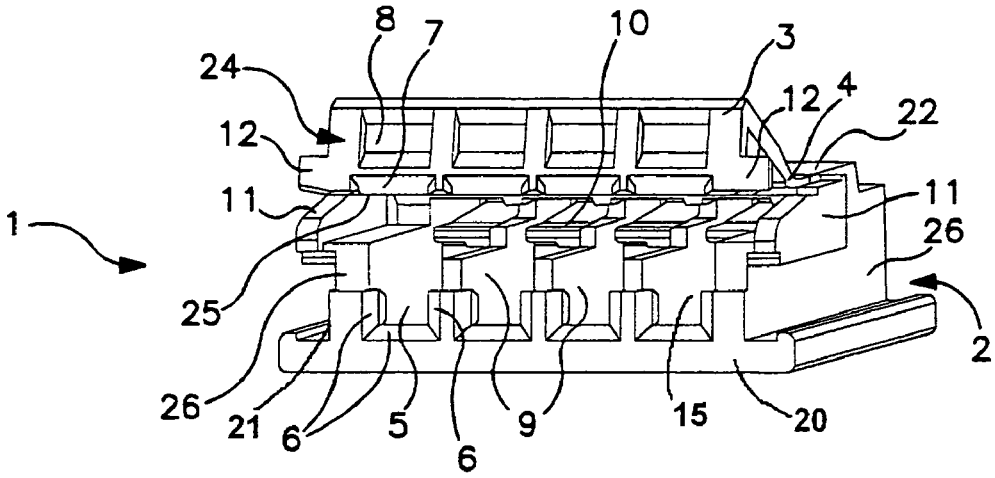
FIG. 1 shows a perspective illustration of a connector housing with a pivoting part in an open position.

The connector housing 1 is substantially made from an insulating material and is preferably made from synthetic material by an injection molding process. The connector housing 1 has a base part 2 and a pivoting part 3 connected to the base part 2. The base part 2 includes a base plate 20 having a plurality of walls 9 which are arranged perpendicular to the base plate 20, a respective contact chamber 15 being formed between each two walls 9. Constructed on a front side 21 of the base part 2 are U-shaped delimiting surfaces 6, each having three delimiting surface portions. In each case, two delimiting surface portions are arranged parallel to one another and in front of a respective wall 9. A third delimiting surface portion connects the two parallel delimiting surface portions. The delimiting surface 6 delimits on three sides an opening which, in the example illustrated, is constructed as an insertion opening 5.

Figure 3:
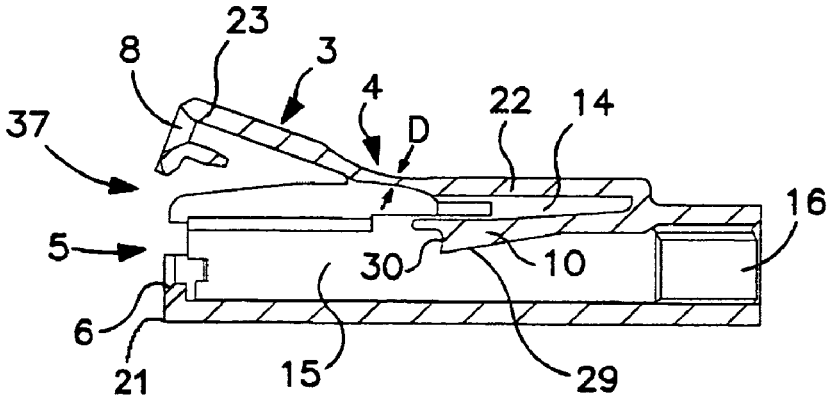
FIG. 3 is a sectional view of the connector housing of FIG. 1 with the pivoting part open.

Arranged between two walls 9, above a contact chamber 15, is a respective latching hook 10 which is connected to a housing top 22 (FIG. 3). The parallel delimiting surface portions are provided up to a fixed height of the walls 9. The pivoting part 3 is attached to the base part 2 by way of a connection wall 4. The connection wall 4 provides a connection between a cover plate 23 of the pivoting part 3 and the housing top 22 of the base part 2. The cover plate 23 is arranged inclined at an upward angle with respect to the housing top 22. The cover plate 23 merges into a front panel 24 which is arranged substantially perpendicular with respect to the cover plate 23. The front panel 24 extends over the entire width of the front side 21 of the base part 2. Provided on the front panel 24 are four openings 8 arranged next to one another in the upper region of the front panel 24. Below the openings 8, the front panel 24 has a continuous edge on which upper delimiting surfaces 7 are arranged next to one another. The upper delimiting surfaces 7 are preferably constructed such that they are downwardly inclined in the direction of the contact chamber 15. The front panel 24 has on the underside an abutment edge 25 which is arranged substantially parallel to the base plate 20. Constructed between the abutment edge 25 and the front side of the base part 2 is a mold opening 37 which serves to receive a mold. The front panel 24 has, on opposite side edges, latching arms 12 which emerge laterally from the front panel 24.

The base plate 20 is connected to the housing top 22 by way of outside walls 26. The outside walls 26 have on their outside latching lugs 11 which are arranged laterally with respect to the front side 21 in the upper region of the outside walls 26. Between an outside wall 26 and the nearest wall 9, a contact chamber 15 is constructed.

Figure 2:
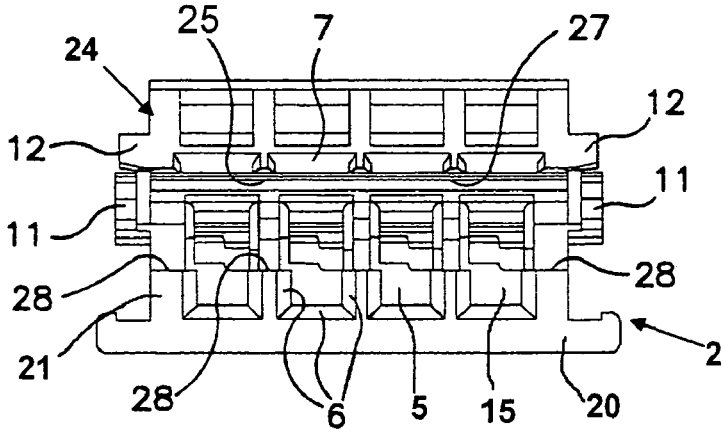
FIG. 2 is a front view of the connector housing of FIG. 1 with the pivoting part open.

FIG. 2 shows the connector housing 1 in front view. The upper delimiting surfaces 7 of the front panel 24 are arranged symmetrically with respect to the central delimiting surface portion of the delimiting surfaces 6 in the base part 2. Moreover, the latching arms 12 are arranged above the latching lugs 11. Between each two upper delimiting surfaces 7, a bearing surface 27 is constructed on the abutment edge 25. Between each two adjacent delimiting surface portions of two insertion openings 5 there is constructed a second bearing surface 28 on the front side 21 of the base part 2.

Figure 4:
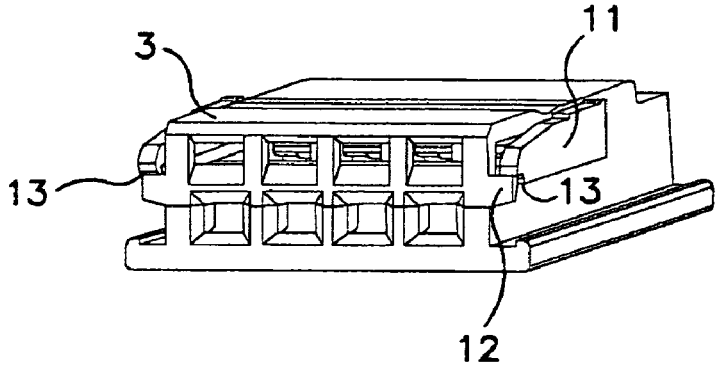
FIG. 4 is a perspective view of the connector housing of FIG. 1 with the pivoting part closed.

FIG. 3 shows a cross-section through the connector housing 1 and the contact chamber 15. A mold opening 37, which is constructed to receive a mold during molding of the connector housing, is provided. Once the mold has been removed, the pivoting part 3 is pivoted and the mold opening 37 is thereby at least made smaller or indeed completely closed off. As a result of the construction of the mold opening 37, the latching hook 10 can be shaped in a simple way even though the front side of the connector housing has in the final (or closed) condition, as illustrated in FIG. 4, only openings 8 and insertion openings 5 which would not be sufficient to accommodate a mold.

The pivoting part 3 is constructed in the form of a hinged flap. In the closed position of the pivoting part 3, the bearing surfaces 27 of the pivoting part 3 lie on the second bearing surfaces 28 of the base part 2. During pivoting of the pivoting part 3, the latching arms 12 come over the latching lugs 11 and latch into corresponding latching recesses 13 below the latching lugs 11. This means that the pivoting part 3 is held in the closed position by way of a latch-type holding arrangement, as illustrated in FIG. 4. In the closed position of the pivoting part 3, the insertion openings 5 are surrounded all round by delimiting surfaces 6, 7. The delimiting surfaces 6, 7 are constructed to taper conically inwards in order to make it easier to introduce a contact pin.

Figure 5:
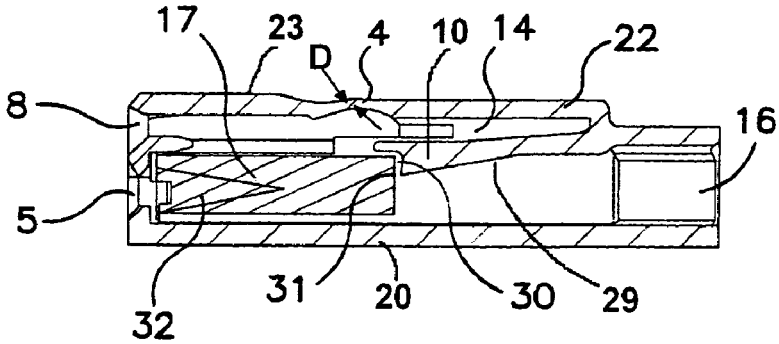
FIG. 5 is a sectional view through the connector housing of FIG. 1 with the pivoting part closed and a contact locked in the housing.

The base part 2 has, opposite the insertion openings 5, socket contact introduction openings 16 for the feeding in of socket contacts 17 (FIG. 5). The latching hook 10 is constructed above the contact chamber 15. The latching hook 10 has an inclined sliding surface 29 which merges at an acute angle into a blocking surface 30 arranged perpendicular to the base plate 20. Constructed between the housing top 22 and the latching hook 10 is a receiving space 14. The housing top 22 extends from the socket contact introduction opening 16 into the end region of the latching hook 10 and then merges by way of a section of less thickness D into the cover plate 23 of the pivoting part 3. The section of less thickness D provides a connection wall 4 by means of which the pivoting part 3 is attached to the base part 2.

In the embodiment illustrated, the connector housing 1 is made from synthetic material with glass fibers. The glass fibers are provided to increase the rigidity of the connector housing 1. As a result of using the glass fibers, the synthetic material may be bent in the region of the connection wall 4 predominantly just after removal of the connector housing 1 from the molds of the injection molding process, that is to say when it is the not yet fully cured condition. After curing, the connection wall 4 is no longer sufficiently resilient because of the combination of synthetic material and glass fibers selected, and if the pivoting part 3 were pivoted into the closed position or out of the closed position the connection wall 4 would break.

Instead of this embodiment, however, it is also possible to use a synthetic material without any glass fiber content, which is flexible in the uncured condition after the molding procedure and makes it possible to pivot the pivoting part 3 into the closed position and keeps the pivoting part 3 in the closed position in the cured condition. Depending on the desired function, it is also possible to use a mold material which remains flexible even in the cured condition in the region of the connection wall 4 because of a correspondingly low thickness D of the connection wall.

Depending on the embodiment, the latching lugs 11 and latching arms 12 may also be dispensed with. In an exemplary embodiment, the connector housing 1 is made from a fiber-reinforced synthetic material. The fiber-reinforced synthetic material provides the possibility of moving the pivoting part 3 from the open position into the closed position while it is in the as yet uncured condition after the injection molding process. Once the synthetic material has cured, the latter has the required rigidity to hold the pivoting part 3. The rigidity of the mold material is particularly advantageous if the pivoting part 3 has a delimiting surface that serves to guide a contact pin. For example, the pivoting part 3 may comprise synthetic material having a high glass fiber content, making the connection wall 4 flexible only in the uncured condition. If, in the uncured condition of the connection wall 4, the pivoting part 3 is moved from the open position into the closed position and held in the closed position until the connector housing 1 has cured, then the pivoting part 3 remains in the closed position once the synthetic material has cured without any latch-type holding being required.

FIG. 5 illustrates a cross-section through the connector housing 1 with a socket contact 17 therein. The socket contact 17 has a second blocking surface 31 which is associated with the first blocking surface 30 of the latching hook 10. The blocking surface 30 and the second blocking surface 31 prevent the contact socket 17 from being pushed out of the socket contact introduction opening 16. On the side with the introduction opening 16, the socket contact 17 can either have a plug contact inserted therein, or be connected to an electrical cable.

The socket contact 17 has a contact region which is opened in the direction of the insertion opening 5. A pin contact can be pushed into the contact region 32 through the insertion opening 5. Instead of the socket contact 17, a plug contact may alternatively be arranged in the contact chamber as a contact and held by the latching hook 10.

The opening 8 may be used for example to reach under the latching hook 10 with an appropriately shaped tool and to raise it up. Thus, the blocking surface 30 of the latching hook 10 releases the second blocking surface 31 of the socket contact 17 so that the socket contact can be withdrawn from the socket contact introduction opening 16.

Depending on the geometry of the connector housing 1 that is used, bearing surfaces 27, 28 may also be constructed in other regions, outside the insertion opening 5. For example, the bearing surfaces 27, 28 may also be constructed in the cover plate 23 between the front panel 24 and the latching hooks 10, with the pivoting part 3 taking the form of a cover. However, other geometries of the pivoting part 3 are also possible. Thus, the position of the mold opening 37 may also be selected as a function of the structure of the connector housing.

What is claimed is:

1. A connector housing, comprising:

a pivoting part; and a base part; the pivoting part and the base part defining a receiving space and a contact chamber, configured to receive a contact; the contact chamber having an insertion opening in communication with the contact chamber; the insertion opening being surrounded by a delimiting surface, with one portion of the delimiting surface being formed by the pivoting part and another portion of the delimiting surface being formed by the base part;

wherein a latching hook is provided in the contact chamber adjacent to the receiving space for latching the contact inside the contact chamber, the latching hook being integrally formed with the connector housing; the pivoting part and the base part abut against one another by way of abutment surfaces proximate the delimiting surface such that the latching hook is displaceable into the receiving space; and the pivoting part and the base part are integrally formed, such that during the molding procedure the pivoting part is located in an open position in which the abutment surfaces of the base part and the pivoting part are spaced apart, and that after the molding procedure while the mold material is still in a not yet fully cured condition the pivoting part is moved into a closed position in which the abutment surfaces of the base part and the pivoting part approach one another.

2. A connector housing according to claim 1, wherein the pivoting part is connected to the base part by a connection wall, with the connection wall having less thickness than the base part and the pivoting part.

3. A connector housing according to claim 1, wherein the connector housing is molded from a fiber-reinforced synthetic material.

4. A connector housing according to claim 1, wherein the pivoting part is held in the closed position against the base part by a latch-type holding arrangement.

5. A connector housing according to claim 1, wherein the pivoting part has a front panel which forms part of a front side of the connector housing; a plurality of openings are arranged next to one another on the front side of the connector housing, each opening being delimited by delimiting surfaces; the abutment surface of the pivoting part is constructed on the front panel; and a portion of the delimiting surfaces of the openings are formed by the front panel.

6. A connector housing according to claim 5, wherein an opening is provided in the front panel of the pivoting part in communication with the receiving space, the opening allowing the introduction of a tool for releasing the latching hook from the contact.

7. A connector housing having a pivoting part and a base part and a latching hook, the pivoting part and the base part defining a contact chamber for receiving a contact and a receiving space adjacent to the contact chamber for allowing displacement of the latching hook; the connector housing having an insertion opening communicating with the contact chamber, the latching hook being disposed in the contact chamber for latching the contact inside the contact chamber and being displaceable into the receiving space by a contact during insertion or extraction thereof, the connector housing being integrally formed with the latching hook by a molding procedure;

wherein the pivoting part and the base part are integrally formed; the pivoting part is located in an open position during the molding procedure providing a mold opening between the base part and the pivoting part, and while the mold material is still in a not yet fully cured condition the pivoting part is movable to a closed position in which the mold opening is made smaller; and the mold material cures in the closed position so that the pivoting part is held in the closed position.

8. A connector housing according to claim 7, wherein the pivoting part is connected to the base part by a connection wall, with the connection wall having less thickness than the base part and the pivoting part.

9. A connector housing according to claim 7, wherein the connector housing is molded from a fiber-reinforced synthetic material.

10. A connector housing according to claim 7, wherein the pivoting part is held in the closed position against the base part by a latch-type holding arrangement.

11. A process for making a connector housing having a base part and a pivoting part, the base part and the pivoting part defining a contact chamber for receiving a contact, the connector housing having an insertion opening into the contact chamber, the insertion opening being surrounded by delimiting surfaces, at least one part of the delimiting surface being formed by the pivoting part and at least one other part of the delimiting surface being formed by the base part, a latching hook being provided in the contact chamber, the process comprising the steps of:

molding the base part, the pivoting part, and a latching hook in one piece with the pivoting part being located in an open position in which a mold opening is formed between the pivoting part and the base part for a mold, the mold being arranged in the mold opening during the molding procedure;

removing the mold through the mold opening; and after the mold has been removed, with the mold material still in a not yet fully cured condition, moving the pivoting part into a closed position in which the mold opening is made smaller, such that the pivoting part forms one part of the delimiting surfaces of the opening.

12. A process according to claim 11, wherein a fiber-reinforced synthetic material is used as the mold material and cures after the molding procedure.

13. A process for making a connector housing having a base part and a pivoting part, the base part and the pivoting part defining a contact chamber for receiving a contact, the connector housing having an insertion opening into the contact chamber and a latching hook provided inside the contact chamber for latching the contact, the process comprising the steps of:

molding the base part, the pivoting part and the latching hook in one piece by a molding procedure with the pivoting part being located in an open position in which a mold opening is formed between the pivoting part and the base part, a mold being arranged in the mold opening during the molding procedure;

removing the mold;

after the mold has been removed, with the mold material still in a not yet fully cured condition, moving the pivoting part into a closed position in which the mold opening is made smaller; and allowing the mold material to cure in the closed position, such that, as a result of the change in rigidity in the mold material, the pivoting part is held in the closed position.

14. A process according to claim 13, wherein a fiber-reinforced synthetic material is used as the mold material and cures after the molding procedure.

15. A process according to claim 14, wherein the pivoting part is connected to the base part by a connection wall, with the connection wall having less thickness than the base part and the pivoting part.

16. A process according to claim 15, wherein the pivoting part is held in the closed position against the base part by a latch-type holding arrangement.

17. A process according to claim 15, wherein the pivoting part has a front panel which forms part of a front side of the connector housing; a plurality of openings are arranged next to one another on the front side of the connector housing, each opening being delimited by delimiting surfaces; the abutment surface of the pivoting part is constructed on the front panel; and a portion of the delimiting surfaces of the openings are formed by the front panel.

18. A process according to claim 17, wherein an opening is provided in the front panel of the pivoting part in communication with a receiving space, the receiving space being arranged adjacent to the latching hook to receive the latching hook when the latching hook is displaced by the contact, the opening allowing the introduction of a tool for releasing the latching hook from the contact.

19. A connector housing comprising:

a base part;

a pivoting part being integrally molded in an open position and connected to the base part by a connection wall, the pivoting part being pivotable to a closed position;

a contact chamber being defined by the base part and the pivoting part in the closed position;

a receiving space located adjacent to the contact chamber and also being defined by the base part and the pivoting part in the closed position;

a latching hook disposed in a contact chamber and being displaceable into the receiving space.

20. A connector housing according to claim 19, wherein the connection wall has less thickness than the base part and the pivoting part.

21. A connector housing according to claim 19, wherein the connector housing is molded from a fiber-reinforced synthetic material.

22. A connector housing according to claim 19, wherein the pivoting part is held in the closed position against the base part by a latch-type holding arrangement.

23. A connector housing according to claim 19, wherein the pivoting part has a front panel which forms part of a front side of the connector housing; a plurality of openings are arranged next to one another on the front side of the connector housing, each opening being delimited by delimiting surfaces; and a portion of the delimiting surfaces of the openings are formed by the front panel.

24. A connector housing according to claim 23, wherein an opening is provided in the front panel of the pivoting part, the opening being in communication with the receiving space and allowing the introduction of a tool for releasing the latching hook from the contact.

* * * * *